US005174679A

United States Patent [19]

Wolf

[11] Patent Number: 5,174,679

[45] Date of Patent: Dec. 29, 1992

[54] PROTECTOR FOR BORE RODS AND PUMP RODS

[75] Inventor: Günter Wolf, Hanover, Fed. Rep. of Germany

[73] Assignee: Gummi-Jäger Kommanditgesellschaft GmbH & Cie, Hanover, Fed. Rep. of Germany

[21] Appl. No.: 761,678

[22] Filed: Sep. 18, 1991

[30] Foreign Application Priority Data

Sep. 18, 1990 [DE] Fed. Rep. of Germany ..... 4029523

[51] Int. Cl.[5] ..... B25G 3/00

[52] U.S. Cl. ..... 403/344; 403/373; 175/325.1; 166/241.1

[58] Field of Search ..... 403/344, 373; 175/325.1, 325.2, 325.3, 325.4, 325.5, 325.6, 325.7; 166/241.1, 241.2, 241.3, 241.4, 241.5, 241.6, 241.7

[56] References Cited

U.S. PATENT DOCUMENTS 1,566,586 12/1925 Dodsou ..... 166/241.4
1,578,304 3/1926 Werner ..... 166/214.4 X
1,736,178 11/1929 Sutton ..... 166/241.4
3,528,499 9/1970 Collett ..... 175/325.6 X
4,473,024 9/1984 Armstrong ..... 403/344 X

*Primary Examiner*—Andrew V. Kundrat
*Attorney, Agent, or Firm*—Robert W. Becker & Associates

[57] ABSTRACT

A protector for bore rods and pump rods that is frictionally connected to the rods comprises an elastomeric body with a metal reinforcement. The elastomeric body comprises a middle section and end pieces whereby the end pieces have a diameter that is reduced relative to a diameter of the middle section. Metal sleeves enclose the end pieces for receiving radially acting forces resulting from heat expansion of the elastomeric body during operation. The length of the metal sleeves is preferably greater than the inner diameter of the metal sleeves. The end pieces that are enclosed by the metal sleeves are radially pre-loaded with respect to the metal sleeves at ambient temperature. The radial thickness of the wall of the end pieces and the length of the metal sleeves are selected such that at elevated temperatures during operation the pressure exerted by the protector onto the bore rods respectively pump rods is greater than at ambient temperature so that the heat expansion improves the frictional connection between the protector and the respective rods.

16 Claims, 1 Drawing Sheet

PROTECTOR FOR BORE RODS AND PUMP RODS

BACKGROUND OF THE INVENTION

The present invention relates to a protector for bore rods and pump rods that comprises an elastomeric body with a metal reinforcement having a middle section and end pieces whereby the end pieces have a diameter that is reduced relative to a diameter of the middle section. The protector is frictionally connected to the bore rods and pump rods.

Due to the fact that with such protectors operational temperatures of approximately 150° C. may occur many attempts have been made to provide the protectors with metal reinforcements in order to improve the frictional connection. However, with known protectors which commonly have metal reinforcements at their inner circumference the expansion forces of the elastomer material overcome the metal reinforcement.

It is therefore an object of the present invention to provide protectors of the aforementioned kind with which the unavoidable forces resulting from heat expansion may be employed to improve the frictional connection between the protector and the bore rods respectively pump rods.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
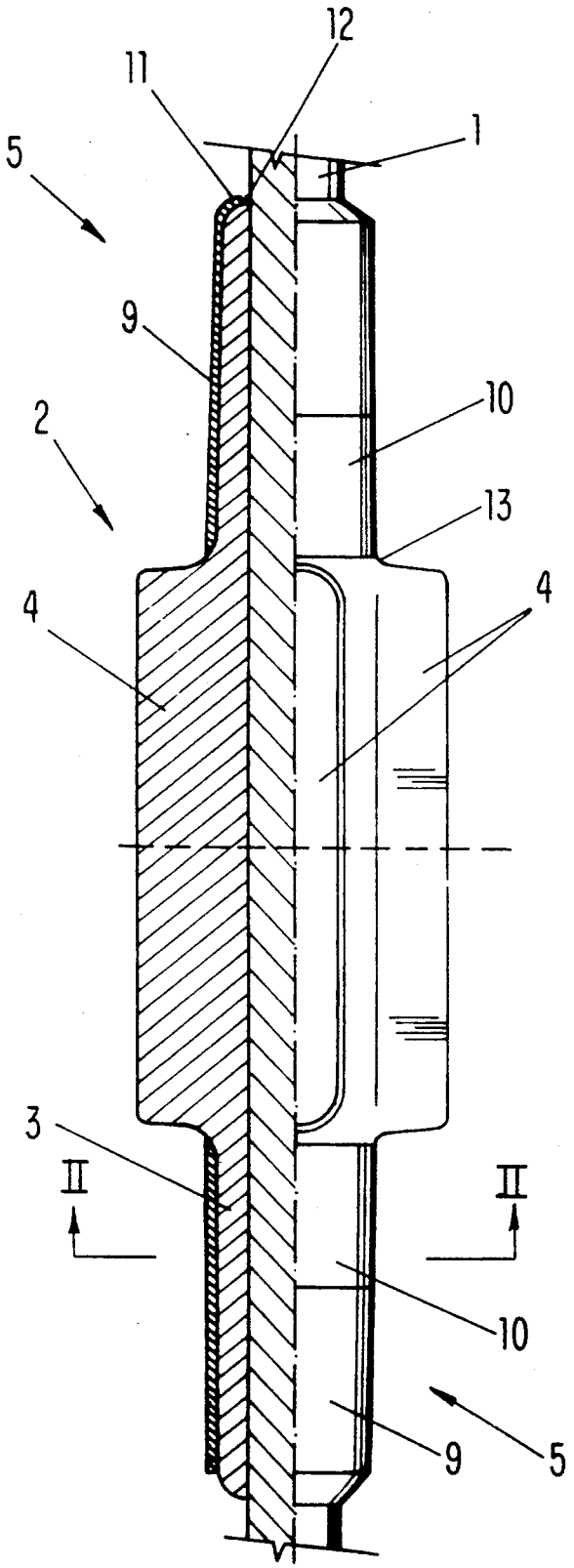
FIG. 1 shows a pump rod arrangement for a deep well pump with the upper half in a cross-sectional view and the lower half in an elevated view, whereby the ends of the protector are shown in two different embodiments, only one of which is respectively used in practice for both ends of one individual protector.

The protector of the present invention is primarily characterized by an elastomeric body that comprises a middle section and end pieces, with the end pieces having a diameter that is reduced relative to a diameter of the middle section; and metal sleeves enclosing the end pieces for receiving radially acting forces resulting from heat expansion of the elastomeric body.

It is preferable that a length of the metal sleeves is greater than an inner diameter of the metal sleeves. With a protector that is reinforced according to the present invention the forces resulting from heat expansion do not cause a loosening of the frictional connection of the protector to the bore rods respectively pump rods. To the contrary, the expansion forces result in an increase of the pressure exerted by the protector onto the bore rods respectively the pumping rods due to the stiff metal sleeves. The metal sleeves according to the present invention are especially effective because they are comparatively long and prevent disadvantageous axial forces.

It is especially preferred that the length of the metal sleeves be essentially twice as great as the inner diameter of the metal sleeves. It is furthermore preferable that the length of the metal sleeves corresponds essentially to a length of the middle section of the protector.

In a preferred embodiment the metal sleeves extend over the entire length of the endpieces. Furthermore, the metal sleeves may be provided with a bent portion at an end thereof that is arranged at a free end of the end pieces. The bent portion rests preferably against adjacent portions of the protector. The metal sleeves may also be provided with a radially outwardly extending end that faces the middle section of the protector. Preferably, the radially outwardly extending end rests against adjacent portions of the protector.

In order to provide a secure fixation of the metal sleeves on the end pieces the metal sleeves are provided in a slightly conical form. Accordingly, when the metal sleeves are pressed onto the end pieces they center themselves and at the same time increase the radial pre-load within the end pieces. In order to improve the radial stiffness of the metal sleeves, the metal sleeves may be provided with the aforementioned bent portion at their end that is arranged at the free end of the end pieces. This bent portion rests against the face of the end piece. It is also expedient to provide the metal sleeves with a radially outwardly extending end which is facing the middle section of the protector and which rests at the face of the middle section.

In a preferred embodiment the protector comprises two halves. The two halves may be connected by groove and tongue joints. In another embodiment the protector is provided with a longitudinal slot to facilitate mounting.

It is preferred that the metal sleeves widen conically toward the middle section of the elastomeric body. It is especially preferred that the metal sleeves have a section that is facing the middle section of the protector and that widens conically.

The end pieces that are enclosed by the metal sleeves are preferably radially pre-loaded with respect to the metal sleeves at ambient temperature. It is expedient that the metal sleeves are provided in a one-piece seamless form. Preferably, a radial thickness of a wall of the end pieces and a length of the metal sleeves are selected such that at elevated temperatures during operation a pressure exerted by the protector onto the bore rods, respectively the pumping rods, is greater than at ambient temperature.

DESCRIPTION OF PREFERRED EMBODIMENTS

Figure 2:
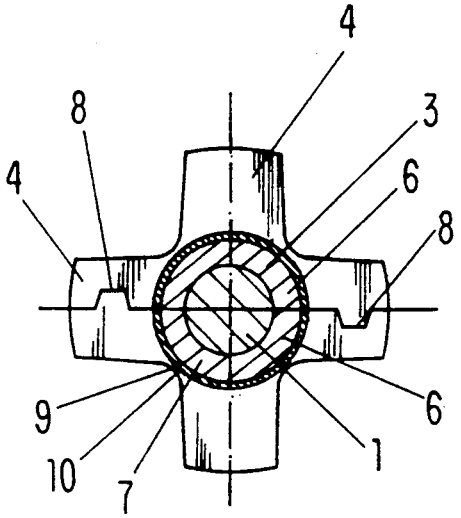
FIG. 2 shows a view along the lines II—II of FIG. 1.

The present invention will now be described in detail with the aid of several specific embodiments utilizing FIGS. 1 and 2.

The bore rods respectively pump rods 1 are provided with a plurality of protectors 2 that are spaced from one another and are comprised of a wear-resistant elastomer. They are attached to the rods in a non-slidable manner, however, they may be mounted at any desired location without having to slide the protectors 2 onto the individual sections of rods.

The protector 2 is provided with a continuous cylindrical body 3 over its entire length which in its middle section is provided with bar-shaped projections 4 that are distributed equally spaced over the circumference of the cylindrical body 3. The outer diameter of the protector 2 which is defined by the bar-shaped projections 4 corresponds to the diameter of the pipe that receives the bore rods respectively pumping rods.

The middle section which is provided with the bar-shaped projections 4 has a transition into respective end pieces at either side of the middle section. The end pieces 5 have a length which is somewhat shorter than the length of the middle section with the bar-shaped projections 4. As can be seen in FIG. 2 the protector 2 comprises two essentially identical halves 6, 7 which are jointed by a groove and tongue joint 8 provided in the area of the bar-shaped projections 4. This division allows the mounting of the protectors 2 at selected positions of the bore rods respectively pump rods 1 by simply positioning the halves 6,7 onto the rods and joining them.

The two end pieces 5 are tightly enclosed by respective metal sleeves 9 which are pressed onto the end pieces 5 in an axial direction whereby a slight deformation of the end pieces 5 takes place. This step may be carried out by hydraulically operated presses. The metal sleeves 9 consist of a material of a high stiffness and are preferably in the form of a one-piece seamless form. In order to provide a good press fit in the axial direction a section 10 is provided at the metal sleeve 9 adjacent to the middle section. The section 10 conically widens in the direction of mounting. The metal sleeve 9 which in the drawing FIG. 1 is attached to the left end piece 5 is essentially of a cylindrical embodiment, with the exception of the conical section 10.

The metal sleeve 9 attached to the end piece 5, shown in the right half of the drawing 1, is provided with a bent portion 11 at the free end of the protector 2. The bent portion which points radially inwardly rests at the conical face 12 of the end piece 5. This arrangement provides an increased stiffness. In the embodiment shown in the upper portion of the right half of drawing FIG. 1 the end of the metal sleeve 9 which is facing the bar-shaped projections 4 extends only slightly in an upwardly and radially outwardly oriented direction while the embodiment of the metal sleeve 9 represented in the lower part of the right half of FIG. 1 is provided with a trumpet-like expanded end section 13 which, when the cylindrical body with the projections 4 is correspondly shaped rests at the projections 4. Due to this arrangement the end of the metal sleeves 9 that is facing the middle section of the cylindrical body 3 is also provided with a radial reinforcement.

Due to the inventive metal sleeves 9 that are pressed onto the end pieces 5 the fixation of the protectors 2 onto the bore rods respectively pump rods 1 is ensured. When the temperature increases during operation, for example, temperatures of 150° C. may be reached, the elastomeric material will be affected by this temperature increase, however the expansion of the elastomeric material cannot result in a radial expansion of the elastomeric material within the area of the end pieces 5 since the metal sleeves 9 will prevent this expansion. The resulting radial tensions will cause an increase of the pressure exerted by the protector 2 against the bore rods 1 respectively pump rods. Accordingly, the frictional connection is improved especially since due to the length of the metal sleeves 9 it is ensured that the heat expansion may not take place in an axial direction.

Instead of providing the protector in the form of two halves 6,7 which are jointed by groove and tongue joints it is also possible to provide a one-piece elastomer body with a longitudinal slot.

The present invention is, of course, in no way restricted to the specific disclosure of the specification and drawings, but also encompasses any modifications within the scope of the appended claims.

What I claim is:

1. A protector for bore rods and pump rods being frictionally connected to said bore rods an pump rods, said protector comprising:

an elastomeric body comprising a middle section and end pieces, said end pieces having a diameter that is reduced relative to a diameter of said middle section; and metal sleeves enclosing said end pieces for receiving radially acting forces resulting from heat expansion of said elastomeric body; and said protector comprising two halves connected by groove and tongue joints.

2. A protector according to claim 1, wherein a length of said metal sleeves is greater than an inner diameter of said metal sleeves.

3. A protector according to claim 2, wherein said length of said metal sleeves is essentially twice as great as said inner diameter of said metal sleeves.

4. A protector according to claim 3, wherein said length of said metal sleeves corresponds essentially to a length of said middle section.

5. A protector according to claim 1, wherein said metal sleeves extend over an entire length of said end pieces.

6. A protector according to claim 1, wherein said metal sleeves have a bent portion at an end thereof arranged at a free end of said end pieces.

7. A protector according to claim 6, wherein said bent portion rests against adjacent portions of said protector.

8. A protector according to claim 1, wherein said metal sleeves has a radially outwardly extending end facing said middle section of said protector.

9. A protector according to claim 8, wherein said radially outwardly extending end rests against adjacent portions of said protector.

10. A protector according to claim 1, wherein said protector is provided with a longitudinal slot.

11. A protector according to claim 1, wherein said metal sleeves widen conically towards said middle section of said elastomeric body.

12. A protector according to claim 11, wherein said metal sleeves have a section that is facing said middle section and that widens conically.

13. A protector according to claim 1, wherein said end pieces that are enclosed by said metal sleeves are radially pre-loaded with respect to said metal sleeves at ambient temperature.

14. A protector according to claim 1, wherein a length of said metal sleeves is essentially twice as great as an inner diameter of said metal sleeves.

15. A protector according to claim 1, wherein said metal sleeves are provided in a onepiece seamless form.

16. A protector according to claim 1, wherein a radial thickness of a wall of said end pieces and a length of said metal sleeves are selected such that at elevated temperatures during operation a pressure exerted by said protector onto said bore rods and said pump rods is greater than at ambient temperature.

* * * * *